US007549546B2

(12) United States Patent
Kröll et al.

(10) Patent No.: US 7,549,546 B2
(45) Date of Patent: Jun. 23, 2009

(54) WIND SAFETY DEVICE FOR CRANES

(75) Inventors: Joachim Kröll, Jüchen (DE); Marie-Jeanne Chargé-Kröll, legal representative, Jüchen (DE); Hermann Franzen, Mönchengladbach (DE); Jannis Moutsokapas, Monheim (DE)

(73) Assignee: Gottwald Port Technology GmbH, Duesseldorf (DE)

( * ) Notice: Subject to any disclaimer, the term of this patent is extended or adjusted under 35 U.S.C. 154(b) by 307 days.

(21) Appl. No.: 11/664,758

(22) PCT Filed: Feb. 8, 2006

(86) PCT No.: PCT/EP2006/001093

§ 371 (c)(1),
(2), (4) Date: Apr. 4, 2007

(87) PCT Pub. No.: WO2006/084673

PCT Pub. Date: Aug. 17, 2006

(65) Prior Publication Data

US 2009/0120890 A1 May 14, 2009

(30) Foreign Application Priority Data

Feb. 11, 2005 (DE) ..... 10 2005 006 206

(51) Int. Cl.
*B66C 7/16* (2006.01)

(52) U.S. Cl. ..... 212/271; 212/324

(58) Field of Classification Search ..... 212/324, 212/271

See application file for complete search history.

(56) References Cited

U.S. PATENT DOCUMENTS

| | | | | | |
|---|---|---|---|---|---|
| 1,772,857 | A | * | 8/1930 | Clark | 104/2 |
| 1,994,260 | A | * | 3/1935 | Van Syckle | 188/43 |
| 2,252,648 | A | * | 8/1941 | Scobie | 188/33 |
| 3,807,532 | A | * | 4/1974 | Molt | 188/43 |

FOREIGN PATENT DOCUMENTS

| | | | | |
|---|---|---|---|---|
| DE | 199 13 980 | A | * | 9/2000 |
| JP | 2003-238069 | A | * | 8/2003 |
| SU | 586106 | A | * | 12/1977 |

* cited by examiner

*Primary Examiner*—Thomas J. Brahan
(74) *Attorney, Agent, or Firm*—Van Dyke, Gardner, Linn & Burkhart, LLP

(57) ABSTRACT

The invention concerns a wind safety device for at least two outdoor cranes (2a, 2b), able to move by traveling gears (6) on a jointly shared crane track (1), especially track-mounted full gantry cranes, with holding devices engaging at or in the region of the crane track (1) to prevent the cranes (2a, 2b) from lifting up and being pulled away when certain wind speeds are exceeded, and it being possible to join together at least two neighboring cranes (2a, 2b) in the region of the traveling gears (6).

In order to achieve greater safety against the lifting up and pulling away of cranes (2a, 2b) taken out of operation due to high wind speeds prevailing, it is proposed that impact elements (10a, 10b) be arranged above the coupling on the at least two neighboring cranes (2a, 2b), lying against each other when the at least two neighboring cranes (2a, 2b) are coupled together.

26 Claims, 2 Drawing Sheets

WIND SAFETY DEVICE FOR CRANES

CROSS REFERENCE TO RELATED APPLICATIONj

The present application claims the priority benefits of International Patent Application No. PCT/EP2006/001093, filed on Feb. 8, 2006, which is hereby incorporated herein by reference in its entirety.

FIELD OF THE INVENTION

The invention relates generally to a wind safety device for at least two outdoor cranes.

BACKGROUND OF THE INVENTION

According to current rules and regulations (e.g., DIN 15 019, Part 1), cranes working outdoors must be taken out of operation after a certain wind speed and be secured against being lifted up and pulled away from the crane track by the wind. The wind speed for halting operation depends on the model of crane. Diverse holding devices for cranes are known; for the most part, use is made of track pinch bars (for example, see DD 285 747). Drag shoes, mechanical locking systems, and track brakes are also used. When using track brakes, the braking capacity to be installed is determined according to the rolling resistance of the track traveling gear, the effective wind attack surface for the crane, its form factors, and the dynamic pressure. The form factors and dynamic pressure are found by using a reference wind speed according to the location of the crane. The installed braking capacity can also be minimized by having an engine brake. Mathematical verification of crane tip-over safety is also done by using the above data and values.

Moreover, a crane connection for at least two tall cranes in harbor facilities is already known from German patent application DE 199 13 980 A1. This crane connection comprises at least one coupling piece on each crane, by which the cranes can be joined together to achieve a high stability against tipping over when the wind is blowing. This type of crane connection is supposed to have the advantage of saving on center ballast and bracing cables on the cranes. The cranes in this case are full gantry cranes, which can travel on rails by traveling gears. The coupling pieces are designed as bolt connections with corresponding shackles arranged on the cranes. Preferably, the coupling pieces can be automatically joined to each other. The coupling pieces are to be installed at the bottom, in the region of the traveling gears on the gantry, and/or at the top of the crane.

The problem solved by the present invention is to improve a wind safety device for cranes, such as full gantry cranes with tracks and brakes, to achieve greater safety against a crane being lifted up and pulled away by the wind when the crane that is taken out of operation on account of high wind speed.

SUMMARY OF THE INVENTION

The problem is solved by a wind safety device for at least two outdoor cranes which can travel on a jointly shared track by means of traveling gears, such as track-mounted full gantry cranes, with the features of claim 1. Advantageous embodiments of the invention are indicated in the subsidiary claims.

According to the invention, a wind safety device for at least two outdoor cranes, such as track-mounted full gantry craned, is able to move by traveling gears on a jointly shared crane track. Holding devices engage at or in the region of the crane track to prevent the cranes from being lifted up and pulled away when certain wind speeds are exceeded, and it is possible to join together at least two neighboring cranes in the region of the traveling gears. An improved wind safety is achieved in that impact elements are arranged above the coupling on the at least two neighboring cranes, lying against each other, when the at least two neighboring cranes are coupled together.

Because of the coupling of two neighboring cranes, the installed braking capacity of these two or possibly additional coupled cranes is available to protect against the crane being pulled away by the wind in the switched-off operating condition. The same is true of the lifting up of the cranes by wind force, which is opposed by twice the weight of the cranes coupled together.

In addition to the mechanical coupling of the neighboring cranes in the region of the traveling gears, the invention provides that the cranes coupled together rest against each other by impact elements above the coupling. Due to this combination of upper impact elements, which are provided solely to transmit pressure forces, and the lower mechanical coupling, an optimal protection of the cranes against wind is achieved. This optimal protection is achieved because the wind forces attacking the cranes are diverted by the impact elements into both cranes, such as into their gantries, and thus are absorbed and withstood by the traveling gears of both cranes. The simultaneous mechanical locking in the region of the traveling gears prevents the cranes from being pushed apart in the region of the traveling gears. Furthermore, it is not necessary to provide a locking and unlocking of the impact elements, which facilitates their handling.

Optimal wind protection, including an optimal diverting of the wind forces into the traveling gears, is achieved in that the impact elements are arranged in the upper region of each crane, or in the case of full gantry cranes, in the region of the upper bridge trusses.

Optionally, in terms of design, the impact elements may be in the form of bumpers with end faces that rest against each other to absorb and divert the pressure forces when the at least two neighboring cranes are coupled together.

According to another feature of the invention, the crane directly exposed to the wind in the secured parking position may at least partly cover the one or more cranes coupled to it. Thus, when the arrangement of the cranes relative to each other in the parked position on the common crane track is chosen such that at least one crane or large regions of one or more other cranes are in the lee of the crane first exposed to the wind, this reduces the effective wind attack surface, which is part of the calculation of the braking capacity to be installed, so that the actual performance of the track brakes of the respective cranes is improved.

According to another aspect of the invention, track brakes or another familiar accessory such as drag shoes, mechanical locking systems, track pinch bars or the like are used as holding devices, as have been used heretofore for securing individual cranes on the crane track or on the rails.

According to another feature of the invention, it is proposed that a coupling link be provided for the coupling of the at least two cranes driven directly next to each other, and optionally impinging on each other, with which the neighboring cranes can be interlocked. In event of an impending storm or wind speeds preventing the crane from operating, at least two of the neighboring cranes traveling on the common crane track are driven so close to each other or impinging on each other that both cranes can be interlocked with a coupling link. Once the storm danger is past, this coupling link can be easily removed again, but it joins together the two cranes or possibly several neighboring cranes with additional coupling links as a wind safety device. The cranes will then also make contact in the region of the impact elements.

In another embodiment of the invention, each coupling link joins together two coupling pieces, which are fastened to each crane in the region of the traveling gear in order to absorb tensile and compressive forces acting between the neighboring cranes. The coupling by tensile and compressive connection is thus favorably provided near the ground, where an especially effective coupling of the cranes is achieved in the region of the traveling gear. Furthermore, the coupling pieces are identical in configuration, so that fabrication is simplified and the coupling of the cranes is facilitated, as the coupling pieces always fit together.

Optionally, each coupling piece is fastened to the traveling gear of each crane protruding generally horizontally and parallel to the crane track, so that the opposite free ends of the two coupling pieces can be interlocked in removable manner.

Optionally, these coupling pieces may form the outer ends of the cranes. This may occur when, according to another feature of the invention, the coupling link embraces appropriately configured bearing surfaces configured on the coupling pieces and thereby locks the coupling pieces abutting against each other.

In another embodiment, the coupling link has a double T-shape, and the web can be inserted in recesses in the opposite end faces of the coupling pieces so that the inner sides of the flanges of the coupling link engage with corresponding bearing surfaces on the wall-shaped coupling pieces. Coupling links of such configuration can be very easily manipulated. They are easy to install and just as easy to remove once again.

These and other objects, advantages, purposes and features of the present invention will become apparent upon review of the following specification in conjunction with the drawings. A sample embodiment of the invention is depicted in the drawing and shall be described hereafter. It shows:

DETAILED DESCRIPTION OF THE DRAWINGS

Figure 1:
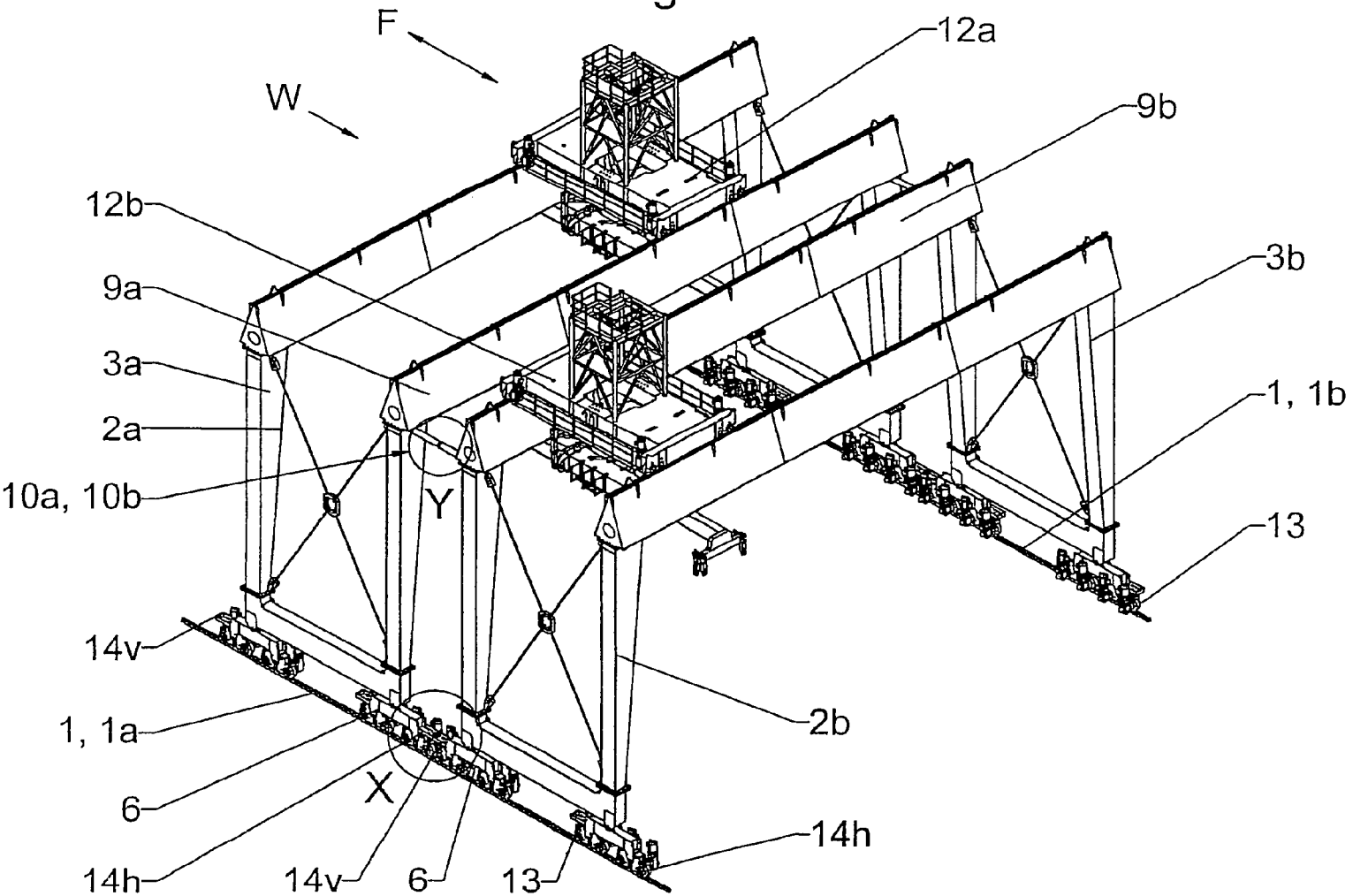
FIG. 1 is a perspective view of two full gantry cranes coupled together according to the invention.

FIG. 1 shows a perspective view of two cranes 2*a* and 2*b*, configured as full gantry cranes and coupled together in a parked position for wind safety, being able to run on a commonly shared crane track 1. Each of the two cranes 2*a*, 2*b* is built conventionally and comprises the four vertical gantry stanchions 3*a*, 3*b*, whose top ends are joined by bridge trusses 9*a*, 9*b* running transversely to the direction of travel F of the cranes 2*a*, 2*b* to form the gantry. On each of the bridge trusses 9*a*, 9*b*, a trolley 12*a*, 12*b* with the hoisting mechanisms arranged on it can travel along the bridge trusses 9*a*, 9*b*. The lower ends of the gantry stanchions 3*a*, 3*b* thrust against a traveling gear 6, which runs on rails 1*a*, 1*b* of a crane track 1. The rails 1*a*, 1*b* run parallel to and at a distance from each other.

Furthermore, the traveling gears 6 each have several wheels 13 which can run on the rails 1*a*, 1*b*, being arranged in succession in the direction of travel F for each traveling gear 6. The lower end of the respective vertical gantry stanchions 3*a*, 3*b* thrusts against the traveling gear 6 roughly in the middle, so that the traveling gear 6 looking in the direction of travel F projects in front of or behind the gantry stanchions 3*a*, 3*b* and thus they form a front end 14*v* and a rear end 14*h* in relation to the particular crane 2*a*, 2*b*.

FIG. 1 also shows the parked position of the two cranes 2*a*, 2*b*, having taken up this position when the operation of the cranes 2*a*, 2*b* had to be halted for safety reasons, such as due to high wind speeds. In the parked position, the cranes 2*a* and 2*b* have come up so close to each other, looking in the direction of travel F, that the two cranes 2*a* and 2*b* lie against each other in the region of their traveling gears 6 by their respective front and rear ends 14*v*, 14*h*. The traveling gears 6 and thus the cranes 2*a*, 2*b* abutting against each other on each rail 1*a*, 1*b* are additionally joined together mechanically in the region of their front and rear ends 14*v*, 14*h* by means of a coupling link 4, which shall be described more closely hereafter in connection with FIG. 2.

In addition, the opposite gantry stanchions 3*a*, 3*b* lie against each other in the parked position in the region of their top ends adjacent to the bridge trusses 9*a*, 9*b*. Since, as described above, the traveling gears 6 project to the front and rear relative to the gantry stanchions 3*a*, 3*b*, in the direction of travel F, when the front and rear ends 14*v*, 14*h* are formed, bumper-like impact elements 10*a*, 10*b* are provided on the gantry stanchions 3*a*, 3*b*. In the parked position, the free ends of the respective impact elements 10*a*, 10*b* touch, but they are not interlocked. The impact elements 10*a*, 10*b* may be simply configured as pipe segments, extending sideways, horizontally and in the direction of travel F from the gantry stanchions 3*a*, 3*b*, and the free end of each impact element 10*a*, 10*b* is closed off to form an end face 11 (see FIG. 3).

Besides the mechanical connection of the traveling gears 6 by the coupling link 4 in the parked position, the holding mechanisms of the two cranes may be brought into play at the same time, for example, by activating the track brakes (not shown) of each crane 2*a*, 2*b*.

Figure 2:
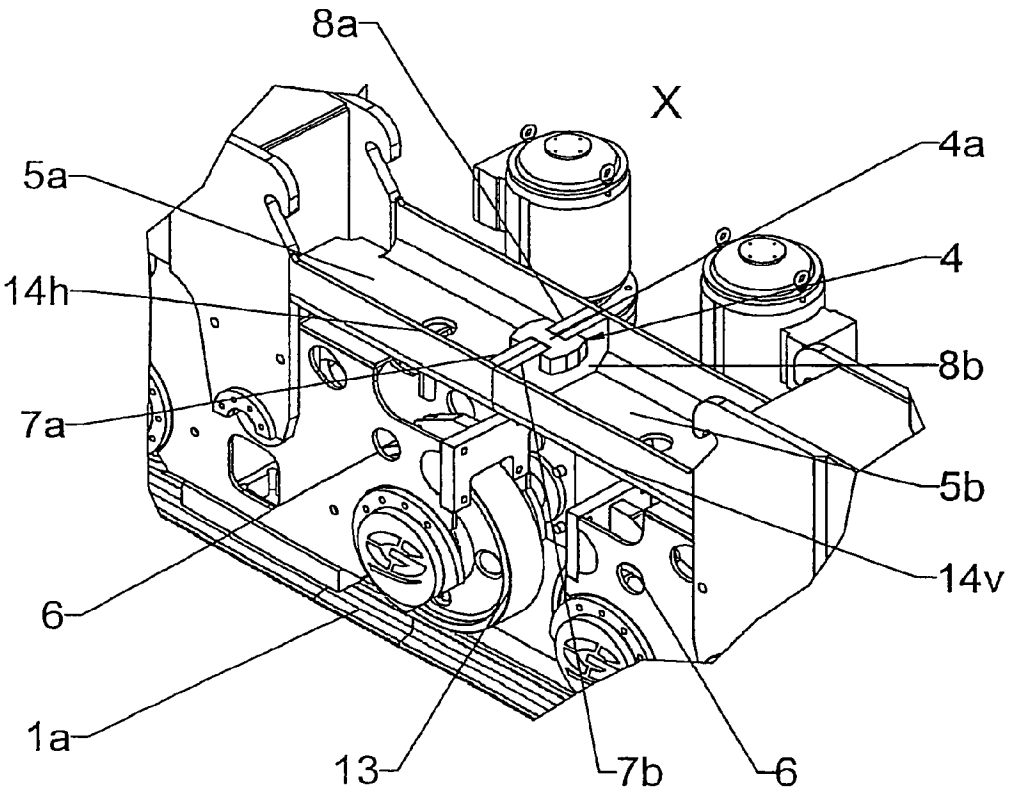
FIG. 2 is a magnified detail view of FIG. 1, from the region of the coupled traveling gears of the gantry cranes.

FIG. 2 shows an enlarged detail view of feature X of FIG. 1, showing the region in which the traveling gears 6 of the cranes 2*a*, 2*b* are coupled together, in the parked position. A coupling piece 5*a* or a coupling piece 5*b* is firmly arranged on each traveling gear 6, forming either the front or the rear end 14*v*, 14*h* of the respective crane 2*a*, 2*b*. The coupling pieces 5*a*, 5*b* are each configured as U-shaped steel sections, which project in parallel to the crane track 1 in the direction of the neighboring crane 2*a* or 2*b* above the wheels 13 of the traveling gear 6. To form a bearing surface, the facing ends 14*v*, 14*h* of the U-shaped coupling pieces 5*a*, 5*b* are each closed off with an end wall 7*a*, 7*b*. In the parked position of the cranes 2*a*, 2*b*, as depicted, the projecting ends 14*v*, 14*h* of the coupling pieces 5*a*, 5*b* may lie against each other with their end walls 7*a*, 7*b*, so that compressive forces acting between the cranes 2*a* and 2*b* can be transmitted across the coupling pieces 5*a*, 5*b* between the cranes 2*a* and 2*b*.

To be able to transmit tensile forces as well between the cranes 2*a* and 2*b* at the same time, in addition to the coupling pieces 5*a* and 5*b* lying against each other, a coupling link 4 may be provided, which clamps together the coupling pieces 5*a* and 5*b* and holds them against each other. The coupling link 4—as can be recognized from FIG. 2—is formed in an I-shape, optionally from a steel plate, and is inserted by its web 4*a* into a corresponding recess in the two coupling pieces 5*a* and 5*b*. This upward open recess is provided in an end wall 7*a*, 7*b* closing off the particular coupling piece 5*a*, 5*b*. End walls 7*a*, 7*b* each include a respective bearing surface 8*a*, 8*b*, at the side away from the bearing surface of the coupling pieces 5*a*, 5*b*, for the inner sides of the flange elements of the I-shaped coupling link 4. Thus, the inner sides of the flange elements engage the bearing surfaces 8*a*, 8*b* of the end walls 7*a* and 7*b* of the coupling pieces 4. In this way, the two cranes 2*a* and 2*b* are interlocked with each other and thereby provide greater safety against wind and storm than conventional devices for individually secured cranes.

Optionally, second crane 2*b* may stand generally in the lee of the first crane 2*a*, which is the case when the wind is blowing from a direction W parallel to the direction of travel F. Lower wind forces then act on the second crane 2*b*, so that this can take over a portion of the braking performance required for the directly exposed crane 2*a*, because of the coupling with the first crane 2*a*.

Figure 3:
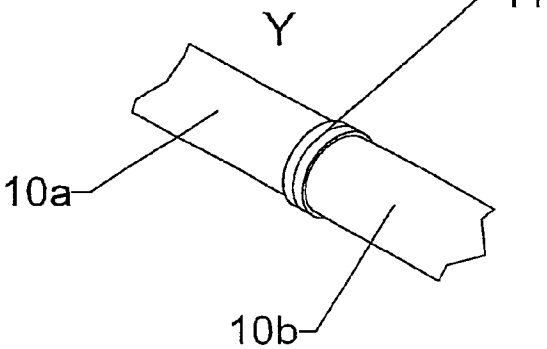
FIG. 3 is a magnified detail view of FIG. 1, from the region of the abutting gantry stanchions of the cranes.

FIG. 3 shows an enlarged detail view of feature Y of FIG. 1, concerning the region of the impact elements 10*a*, 10*b* of the cranes 2*a*, 2*b*, lying against each other in the parked position. The impact elements 10*a*, 10*b* are provided to protect the cranes 2*a*, 2*b* from tipping over under high wind speeds. The end walls 11, positioned at the free ends of the impact elements 10*a*, 10*b*, lie against each other when the end faces of the coupling pieces 5*a* and 5*b* of the traveling gears 6 also abut. In this way, the cranes 2*a*, 2*b* also thrust against each other in the top region and thereby substantially increase the restoring moment of the cranes 2*a*, 2*b* under wind and storm. The free ends of the impact elements 10*a*, 10*b* are not interlocked with each other.

Changes and modifications in the specifically described embodiments can be carried out without departing from the principles of the invention which is intended to be limited only by the scope of the appended claims, as interpreted according to the principles of patent law including the doctrine of equivalents.

The invention claimed is:

1. A wind safety device for at least two outdoor cranes able to move by traveling gears on a jointly shared crane track, comprising:

holding devices engaging the at least two cranes at or in the region of the crane track to prevent the at least two cranes from being lifted up and pulled away when certain wind speeds are exceeded, wherein at least two neighboring cranes may be coupled together in the region of the traveling gears; and impact elements arranged above the coupling on the at least two neighboring cranes, said impact elements lying against each other when the at least two neighboring cranes are coupled together.

2. The wind safety device per claim 1, wherein the impact elements are arranged in the upper region of each crane.

3. The wind safety device per claim 2, wherein the impact elements comprise bumpers with end faces that rest against each other to absorb the pressure forces when the at least two neighboring cranes are coupled together.

4. The wind safety device per claim 3, wherein the crane directly exposed to the wind in the parking position at least partly covers the one or more cranes coupled to it.

5. The wind safety device per claim 4, wherein track brakes, drag shoes, mechanical locking systems or track pinch bars are used as the holding devices.

6. The wind safety device per claim 5, wherein a coupling link is provided for the coupling of the at least two cranes, said at least two cranes being one of neighboring and impinging on each other, wherein the coupling link can interlock the at least two cranes.

7. The wind safety device per claim 6, wherein each coupling link joins together two coupling pieces that are fastened to each crane in the region of the traveling gear, wherein said coupling pieces absorb tensile and compressive forces acting between the one of neighboring and impinging cranes.

8. The wind safety device per claim 7, wherein each coupling piece is fastened to the traveling gear of each respective crane and protrudes generally horizontal and parallel to the crane track, wherein opposite free ends of the two coupling pieces can be interlocked in removable manner by the coupling link.

9. The wind safety device per claim 8, wherein the coupling link engages appropriately configured bearing surfaces on the coupling pieces and locks the coupling pieces abutting against each other.

10. The wind safety device per claim 9, wherein the coupling link has an I-shape, including a web and at least two flange elements, wherein said web can be inserted in recesses in opposite end walls of the coupling pieces, wherein inner sides of the flange elements of the coupling link engage the bearing surfaces on the coupling pieces.

11. The wind safety device per claim 1, wherein the impact elements are in the form of bumpers with end faces that rest against each other to absorb the pressure forces when the at least two neighboring cranes are coupled together.

12. The wind safety device per claim 11, wherein the crane directly exposed to the wind in the parking position at least partly covers the one or more cranes coupled to it.

13. The wind safety device per claim 12, wherein track brakes, drag shoes, mechanical locking systems or, track pinch bars are used as the holding devices.

14. The wind safety device per claim 13, wherein a coupling link is provided for the coupling of the at least two cranes, said at least two cranes being one of neighboring and impinging on each other, wherein the coupling link can interlock the at least two cranes.

15. The wind safety device per claim 14, wherein each coupling link joins together two coupling pieces that are fastened to each crane in the region of the traveling gear, wherein said coupling links absorb tensile and compressive forces acting between the neighboring cranes.

16. The wind safety device per claim 15, wherein each coupling piece is fastened to the traveling gear of each respective crane and protrudes generally horizontal and parallel to the crane track, wherein opposite free ends of the two coupling pieces can be interlocked in removable manner by the coupling link.

17. The wind safety device per claim 16, wherein the coupling link engages appropriately configured bearing surfaces on the coupling pieces and locks the coupling pieces abutting against each other.

18. The wind safety device per claim 17, wherein the coupling link has an I-shape, including a web and at least two flange elements, wherein said web can be inserted in recesses in opposite end walls of the coupling pieces, wherein inner sides of the flange elements of the coupling link engage the bearing surfaces on the coupling pieces.

19. The wind safety device per claim 1, wherein the crane directly exposed to the wind in the parking position at least partly covers the one or more cranes coupled to it.

20. The wind safety device per claim 1, wherein track brakes, drag shoes, mechanical locking systems or, track pinch bars are used as the holding devices.

21. The wind safety device per claim 1, wherein a coupling link is provided for the coupling of the at least two cranes, said at least two cranes being one of neighboring and impinging on each other, wherein the coupling link can interlock the at least two cranes.

22. The wind safety device per claim 21, wherein each coupling link joins together two coupling pieces that are fastened to each crane in the region of the traveling gear, wherein said coupling links absorb tensile and compressive forces acting between the neighboring cranes.

23. The wind safety device per claim 22, wherein each coupling piece is fastened to the traveling gear of each respective crane and protrudes generally horizontal and parallel to the crane track, wherein opposite free ends of the two coupling pieces can be interlocked in removable manner by the coupling link.

24. The wind safety device per claim 21, wherein the coupling link engages appropriately configured bearing surfaces on the coupling pieces and locks the coupling pieces abutting against each other.

25. The wind safety device per claim 24, wherein the coupling link has an I-shape, including a web and at least two flange elements, wherein said web can be inserted in recesses in opposite end walls of the coupling pieces, wherein inner sides of the flange elements of the coupling link engage the bearing surfaces on the coupling pieces.

26. The wind safety device of claim 1, said cranes being full gantry cranes, wherein the impact elements are arranged in the region of the upper bridge trusses.

* * * * *